United States Patent [19]

Risenby et al.

[11] Patent Number: 4,581,830

[45] Date of Patent: Apr. 15, 1986

[54] APPARATUS FOR FLUID-BED DRYING, PARTICULARLY FOR SIMULTANEOUS DRYING AND DISINTEGRATION OF A MATERIAL IN THE FORM OF A PASTE

[75] Inventors: Claus Risenby, Måløv; Henry A. Nielsen, Herlev, both of Denmark

[73] Assignee: APV Anhydro A/S, Denmark

[21] Appl. No.: 663,506

[22] Filed: Oct. 22, 1984

[30] Foreign Application Priority Data

Nov. 10, 1983 [DK] Denmark ..... 5144/83

[51] Int. Cl.[4] ..... F26B 17/10

[52] U.S. Cl. ..... 34/57 D; 34/57 E; 432/58

[58] Field of Search ..... 34/57 D, 57 E, 10, 173; 432/15, 58

[56] References Cited

U.S. PATENT DOCUMENTS

| | | | |
|---|---|---|---|
| 2,316,207 | 4/1943 | Winter | 34/57 E |
| 2,761,769 | 9/1956 | Elder . | |
| 3,386,182 | 6/1968 | Lippert | 34/57 E |
| 4,395,830 | 8/1983 | Lockwood | 34/57 D |

FOREIGN PATENT DOCUMENTS

| | | |
|---|---|---|
| 130338 | 2/1975 | Denmark . |
| 1040968 | 3/1959 | Fed. Rep. of Germany . |
| 2853913 | 3/1980 | Fed. Rep. of Germany . |

OTHER PUBLICATIONS

Anhydro A/S, brochure on Spin Flash Drying.

*Primary Examiner*—Larry I. Schwartz
*Attorney, Agent, or Firm*—Brumbaugh, Graves, Donohue & Raymond

[57] ABSTRACT

The apparatus consists of a cylindrical drying chamber, which is provided with an upwardly conical bottom. The fluidization and drying medium is supplied to the chamber through a substantially circularly extending slit between the conical bottom and the wall of the drying chamber from an annular distributor for the fluidization and drying medium. A stirrer is placed coaxially in the chamber, the blades of said stirrer being parallel to the conical bottom. Preferably, the blades of the stirrer are positioned at a small distance from the conical bottom. The cylindrical drying chamber and the annular distributor may have a common wall, which is provided with a heat insulating layer on the side facing the distributor.

10 Claims, 1 Drawing Figure

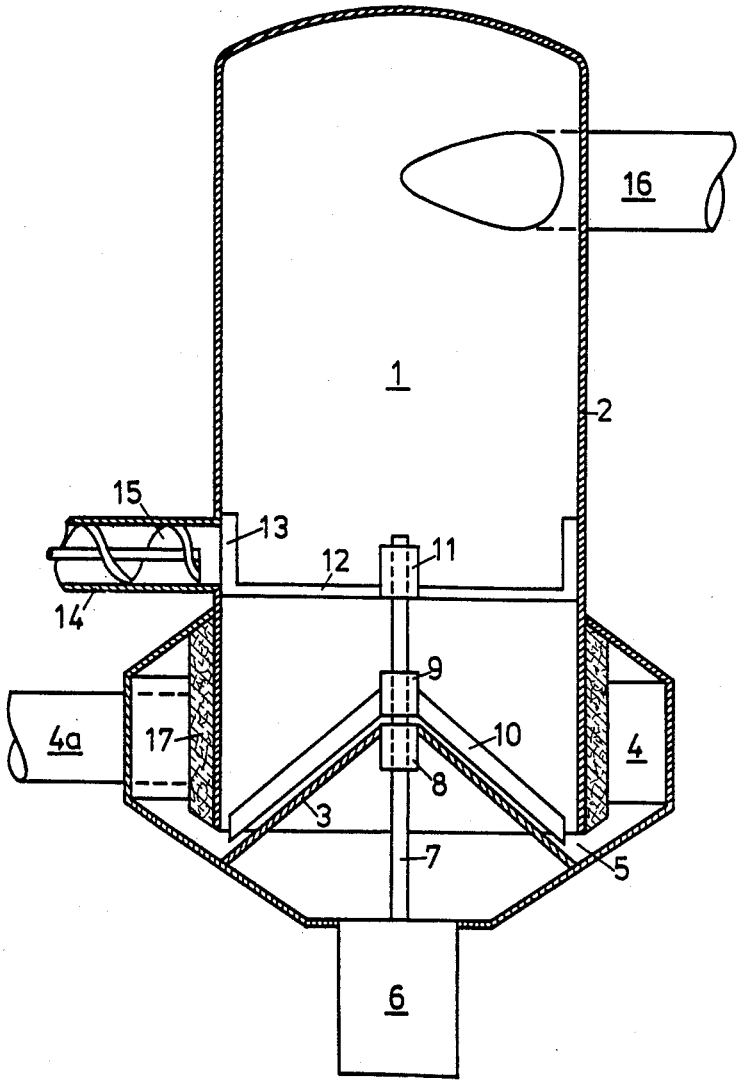
16
1
2
15
13
12
11
14
9
4a
17
10
4
8
3
7
5
6

APPARATUS FOR FLUID-BED DRYING, PARTICULARLY FOR SIMULTANEOUS DRYING AND DISINTEGRATION OF A MATERIAL IN THE FORM OF A PASTE

BACKGROUND OF THE INVENTION

The present invention relates to an apparatus for fluid-bed drying, particularly for simultaneous drying and disintegration of a material in the form of a paste, said apparatus having a cylindrical drying chamber with a conical bottom in fixed connection therewith, and having a rotating stirrer placed coaxially in the drying chamber, the blades of said stirrer being parallel to the conical bottom, and having members for the supply of material to be dried, and also apertures for the supply and removal of the medium for fluidization and drying and for the removal of the dried product.

From Denmark PS No. 130,338 an apparatus is known which produces a rotating floating layer, and which is substantially of the nature mentioned in the introduction, the bottom of said apparatus being narrowed conically downwards, and the fluidization medium being introduced from below through a slit between the wall in the conical bottom and a rotating disc carrying the stirrer blades. It has been explicitly mentioned in the patent specification that the apparatus makes it possible to use fluidization technique, i.a. in the processes of treating pastes.

By the drying of materials in the form of a paste in such a known apparatus a certain portion of the material in larger and smaller moist particles will occur already at their introduction into the drying chamber, the larger particles preferably making for the lowermost part of the fluidized layer in the conical bottom, where the velocity of the drying air will be highest on account of the shape of the bottom. This results partly in a powerful drying of the surfaces of these particles, and partly in a disintegration of the particles caused by the collision between the particles and the rotating blades.

However, in the said apparatus this process is rather incomplete, because, as mentioned, the drying air is introduced, through a slit between the stirrer disc and the wall in the bottom, so that the particles are liable to collect near the middle of the conical bottom and be deposited on the disc near its axis of rotation.

In a further development of such an apparatus a drying chamber with a substantially flat bottom and a stirrer has been used for the drying of materials in the form of a paste. In this case, the stirrer blades extend parallel to the axis of the drying chamber, the drying air being introduced into the chamber through a series of vertical slits at the bottom of the chamber distributed over its circumference. Also by this construction the larger moist particles are liable to be deposited on the bottom of the drying chamber near its axis. A somewhat similar construction is the subject of German DE-OS No. 28 53 913, which deals with an apparatus for the drying of synthetic textile fibres, the drying air being introduced tangentially into the drying chamber at one side of a downwardly arched bottom, above which a stirrer has been provided.

Finally, from U.S. Pat. No. 2,761,769 an apparatus for fluidized catalysis is known, having in a cylindrical chamber a rotating, upwardly conical, perforated bottom, through the perforations of which the fluidization medium is supplied. It is true that by this construction it is obtained that the material will not show any tendency to collect or be deposited at the axis of the chamber, but this apparatus is quite unsuitable for simultaneous drying and disintegration of materials in the form of a paste, as no conditions exist therein which may lead to a disintegration of the larger particles.

SUMMARY OF THE INVENTION

The object of the present invention is to provide an apparatus of the nature described in the introduction, which is particularly suitable for simultaneous drying and disintegration of materials in the form of a paste, and in which a particularly vigorous movement of the most heavy and moist particles is obtained, and at the same time without the particles collecting or depositing near the axis of the drying chamber.

According to the invention this is obtained when the bottom extends conically tapering upwards inside the chamber, and the aperture for the supply of the fluidization and drying medium is a substantially circularly extending slit between the conical bottom and the cylindrical wall of the chamber, and which from an annular distributor for the fluidization and drying medium leads into the chamber.

In this embodiment of the apparatus the most heavy and moist particles will be most likely to gravitate towards the narrowest part of the annular spaced between the cylindrical wall of the chamber and the conical bottom, where the velocity and the temperature of the fluidization and drying medium is highest. This will impart to these particles a vigorous movement, and at the same time a quick drying of their surfaces will take place which by reciprocal collisions between the particles and between the particles and the blades of the stirrer are knocked off, so that an effective disintegration takes place. There will be no tendency on the part of the fluidized particles to collect near the axis of the drying chamber or to be deposited on the bottom, partly because its upwardly conical shape counteracts such depositing, and partly because in such case the blades of the stirrer would remove particles that might have been deposited.

For this reason it is also preferred that the blades of the stirrer are positioned at a relatively small distance from the conical bottom.

In one embodiment of the apparatus according to the invention the cylindrical drying chamber and the annular distributor have a common wall, which is heat insulated on the side facing the distributor. These arrangements allow a constructionally simple design of the apparatus, while at the same time avoiding the hot fluidization and drying medium supplied to the distributor from being imparted at such a high temperature to the inner side of the common wall that it causes partially moist particles to bake on to this part of the wall of the drying chamber.

The upwardly conical bottom offers a special constructional advantage in the case of the drying of materials, which during the drying process may give rise to reactions in the nature of explosions in the drying chamber, whereby high pressures of short duration may occur in the drying chamber, for the reason that the shape of the bottom makes it well suited to resist this kind of sudden rises in the pressure without special bracings or supports.

BRIEF DESCRIPTION OF THE DRAWING

The invention will be described hereinafter in more detail, reference being made to the drawing, which shows schematically a vertical axial section through an apparatus according to the invention.

DESCRIPTION OF THE PREFERRED EMBODIMENTS

The apparatus comprises a drying chamber 1 with a cylindrical wall 2 and an upwardly conical, tapering bottom 3. The lowermost part of the cylindrical wall 2 is surrounded by an annular distributor 4 for the fluidization and a drying medium, e.g. heated air, which is supplied to the distributor 4 through a tangentially introduced pipe 4*a*. A substantially circularly extending slit 5 is provided between the conical bottom 3 and the cylindrical wall 2 of the chamber 1, leading from the distributor 4 into the interior of the chamber 1. Under the bottom 3, a rotating driving member 6 is placed, whose shaft 7 is placed coaxially in the chamber 1 and passed through a bearing 8 at the top of the conical bottom 3. A hub 9 is attached on the shaft 7, carrying a number of stirrer blades 10, which extend parallel to and at a relatively small distance from the upper side of the conical bottom 3. Somewhat above the hub 9, another hub 11 is attached to the shaft 7, from which said hub 11 a number of arms 12 extend, carrying knives 13, which may rotate closely to the inner side of the cylindrical wall 2. Opposite to the knives 13 and coinciding with their path of movement a supply member for paste material is provided in the form of a pipe 14 with a worm conveyor 15. In the upper part of the chamber 1 there is disposed an outlet aperture for the fluidization and drying medium and for the dried, disintegrated product in the form of a tangentially connected pipe 16. Finally, the part of the cylindrical wall 2, which is common to the chamber 1 and the annular distributor 4, is insulated on the side facing the distributor 4 by means of a jacket 17 of heat insulating material.

The apparatus operates as follows:

The material in the form of a paste which is to be dried and disintegrated is supplied to the drying chamber 1 through the pipe 14 by means of the worm conveyor 15. At the outlet from the pipe 14 the paste material is cut off by means of the knives 13, of which two are shown on the drawing, but naturally more may be provided according to requirements. In this way an initial subdivision or disintegration of the paste material is effected in larger and smaller particles, which fall downwards in the chamber towards the bottom 3 by gravitation. As the velocity of the fluidization and drying medium flowing into the drying chamber 1 is highest in the immediate proximity of the slit 5 and slackens upwardly in the chamber 1, as the medium spreads over the annular space between the bottom 3 and the cylindrical wall 2, the largest particles of the paste material will fall deepest down in this space, until they are kept floating in the fluidization medium, at the same time as a vigorous movement is imparted to them, and they are subjected to a powerful drying of their surfaces from the fluidization and drying medium, which has its highest temperature at this point. Owing to the vigorous movement of the particles in this area they will frequently collide with each other and also be hit by the blades 10 of the stirrer, with the effect that the dry surface layer is knocked off, so that a disintegration of these particles takes place, whereafter the smaller particle parts are taken upwards in the chamber 1 by the fluidization medium and leave same through the pipe 16 after final drying. Partly on account of the conical shape of the bottom 3 and partly on account of the effect of the stirrer blades 10, particles falling down on the bottom 3 will be prevented from settling and building up a coating thereon. Therefore it is also preferred that the blades 10 move over the bottom 3 at a small distance from same. In order to prevent moist particles from baking on to the part of the cylindrical wall 2, which is common to the chamber 1 and the annular distributor 4, and form a fixed coating thereon, this part of the wall is insulated on the side facing the distributor 4 with a heat insulating jacket 17 which prevents the part of the wall 2 from being strongly heated by the very hot fluidization and drying medium, which is supplied to the distributor 4.

Various modifications of the apparatus are possible within the scope of the invention. As the fluidization and drying medium is supplied to the annular distributor 4 through the tangentially directed supply pipe 4*a*, guide blades may be provided in the distributor 4 at the slit 5 to change the direction of flow for the medium. Also, in the upper part of the drying chamber 1 guide screens and baffle plates may be provided, as is well known within this field. Finally, the supply and the initial disintegration of the paste material may be effected by means other than those described herein.

We claim:

1. An apparatus for fluid-bed drying, particularly for simultaneous drying and disintegration of a material in the form of a paste, said apparatus comprising:

a generally cylindrical drying chamber with a generally conical bottom in fixed connection therewith, and a rotating stirrer placed coaxially in said chamber, wherein the blades of said stirrer are generally parallel to said conical bottom, means for supplying, material to be dried to the chamber, means for supplying medium for fluidization and drying of the material to be dried, comprising a slit defined in the cylindrical wall, said slit extending around the bottom of the cylindrical chamber between the cylindrical wall and the conical bottom, and a distributor in communication with said slit and with said means for supplying fluidization and drying medium, and means for removing the dried product from said chamber.

2. An apparatus according to claim 1, wherein the blades of said stirrer are positioned relatively close to said conical bottom.

3. An apparatus according to claim 1, wherein said cylindrical drying chamber and said annular distributor have a common wall which is heat insulated on the side facing said distributor.

4. An apparatus according to claim 1, wherein the means for supplying material to be dried to the chamber comprises an inlet aperture in the side wall of the chamber with means for feeding the material to be dried into the chamber.

5. An apparatus according to claim 4, wherein the means for feeding the material to be dried comprises a worm conveyor.

6. An apparatus according to claim 4, further including means at the inlet aperture for cutting the paste material to be dried.

7. An apparatus according to claim 6, wherein the means for cutting the paste material comprises a blade mounted for rotation generally about the chamber's central axis.

8. An apparatus according to claim 7, wherein the blade is mounted to a shaft which extends from the stirrer, whereby the blade and stirrer rotate together.

9. An apparatus according to claim 1, wherein the means for removing the dried product comprises an outlet pipe fitted into the cylindrical wall at the upper end of the chamber.

10. An apparatus for fluid-bed drying, paticularly for simultaneous drying and disintegration of a material in the form of a paste, said apparatus comprising:

a generally cylindrical drying chamber with a generally conical bottom in fixed connection therewith, and a rotating stirrer placed coaxially in said chamber, wherein the blades of said stirrer are generally parallel to and positioned relatively close to said conical bottom;

an inlet aperture in the side wall of the chamber for supplying material to be dried into the chamber;

means for supplying medium for fluidization and drying of the material to be dried, comprising a slit defined in the chamber where the cylindrical wall meets the conical bottom, and a distributor in communication with said slit and with said means for supplying fluidization and drying medium, and an outlet pipe fitted into the cylindrical wall at the upper end of the chamber for removing the dried product from said chamber.

* * * * *